US010935021B2

(12) United States Patent
Beauman et al.

(10) Patent No.: US 10,935,021 B2
(45) Date of Patent: Mar. 2, 2021

(54) MECHANISM FOR COARSE AND FINE ADJUSTMENT OF FLOWS IN FIXED DISPLACEMENT PUMP

(71) Applicant: Fluid Metering, Inc., Syosset, NY (US)

(72) Inventors: Zachary Beauman, Westbury, NY (US); David Rawlings, Sound Beach, NY (US); Joseph Middleton, Hicksville, NY (US)

(73) Assignee: FLUID METERING, INC., Syosset, NY (US)

( * ) Notice: Subject to any disclaimer, the term of this patent is extended or adjusted under 35 U.S.C. 154(b) by 264 days.

(21) Appl. No.: 15/830,592

(22) Filed: Dec. 4, 2017

(65) Prior Publication Data

US 2018/0087497 A1 Mar. 29, 2018

Related U.S. Application Data

(63) Continuation-in-part of application No. 15/027,870, filed on Apr. 7, 2016.

(60) Provisional application No. 61/915,878, filed on Dec. 13, 2013.

(51) Int. Cl.

| | |
|---|---|
| ***F04B 49/12*** | (2006.01) |
| ***F04B 53/16*** | (2006.01) |
| ***F04B 53/14*** | (2006.01) |
| ***F04B 9/02*** | (2006.01) |
| ***F04B 53/22*** | (2006.01) |
| ***F04B 17/00*** | (2006.01) |

(52) U.S. Cl.

CPC ..... *F04B 49/12* (2013.01); *F04B 9/02* (2013.01); *F04B 17/00* (2013.01); *F04B 53/14* (2013.01); *F04B 53/16* (2013.01); *F04B 53/22* (2013.01)

(58) Field of Classification Search

CPC ..... F04B 49/12; F04B 53/16; F04B 17/00; F04B 53/22; F04B 9/02

USPC ..... 417/490

See application file for complete search history.

(56) References Cited

U.S. PATENT DOCUMENTS

| | | | | |
|---|---|---|---|---|
| 2,592,237 A * | 4/1952 | Bradley | ..... | F16H 21/20 74/570.21 |
| 3,382,812 A | 5/1968 | Smith | | |
| 4,334,338 A | 6/1982 | Conn | | |

(Continued)

FOREIGN PATENT DOCUMENTS

| | | |
|---|---|---|
| WO | WO9315316 | 8/1993 |
| WO | WO2011113469 | 9/2011 |

*Primary Examiner* — Christopher S Bobish

(74) *Attorney, Agent, or Firm* — Hoffmann & Baron, LLP

(57) ABSTRACT

An angle adjustment mechanism for a pump and a motor includes a base, two eccentric bushings and a fixed link. The base has a hinge disposed between a motor flange and a pump flange and a pair of spaced apertures disposed opposite the hinge. The first eccentric bushing has a body portion received in a first of the apertures of the base and the second eccentric bushing has a body portion received in one of a second of the apertures of the base or an inner bore of the first eccentric bushing. The axial center line of the inner bore of the first eccentric bushing is offset from an axial center line of the body portion by a first distance and the axial center line of the inner bore of the second eccentric bushing is offset from an axial center line of the body portion by a second distance, wherein the second distance is different from the first distance.

18 Claims, 15 Drawing Sheets

(56) References Cited

U.S. PATENT DOCUMENTS

| | | | | |
|---|---|---|---|---|
| 4,941,809 | A | 7/1990 | Pinkerton | |
| 4,954,046 | A | 9/1990 | Irvin et al. | |
| 5,015,157 | A | 5/1991 | Pinkerton et al. | |
| 5,020,980 | A | 6/1991 | Pinkerton | |
| 5,246,354 | A | 9/1993 | Pardinas | |
| 5,299,446 | A | 4/1994 | Pardinas et al. | |
| 5,301,597 | A * | 4/1994 | Sauer | B60T 11/16 403/28 |
| 5,863,187 | A | 1/1999 | Bensley et al. | |
| 6,540,486 | B2 | 4/2003 | Amsler et al. | |
| 7,708,535 | B2 | 5/2010 | Peeler et al. | |
| 2003/0101786 | A1 * | 6/2003 | Plesh, Sr. | B21B 13/147 72/237 |
| 2016/0245275 | A1 | 8/2016 | Rawlings | |

* cited by examiner

MECHANISM FOR COARSE AND FINE ADJUSTMENT OF FLOWS IN FIXED DISPLACEMENT PUMP

CROSS-REFERENCE TO RELATED APPLICATION

This application is a continuation-in-part of U.S. Ser. No. 15/027,870, filed Apr. 7, 2016, which claims the benefit of U.S. Provisional Application No. 61/915,878, filed Dec. 13, 2013, which is incorporated herein by reference in its entirety for all purposes.

BACKGROUND

A family of valveless pumps, which have at their heart special mounting means, commonly referred to as a base, interposed between a drive motor and a pump head, is known in the art. These bases are typically injection molded plastic and incorporate a living hinge separating an upper portion from a lower portion. The upper portion of the base can be tilted with respect to the lower portion by flexure of the living hinge. The relative angle between the upper and lower portions establishes the pump output volume per revolution. This entire mechanism has been described previously in commonly owned U.S. Pat. Nos. 5,020,980 and 4,941,809.

Conventionally, the method for adjustment and setting of the angle has been accomplished by means of adjusting screw engagement with pivot pins in the two portions of the base, which are positioned on the opposite side of the central axis of the base. Certain applications require pumps with the same target output per revolution. This has been accomplished by substituting fixed linkage means for the adjustable screw and pivot pins. The fixed links are injection molded from plastic resin and the tooling used to mold these links allows for different lengths to be produced such that different target pump displacements can be routinely produced.

The original intention for embracing the fixed link arrangement over the adjustable screw arrangement was to reduce cost. That has been demonstrated to have been accomplished, but there are significant additional advantages to the fixed link concept: 1) Far better mechanical stability due to absence of backlash problems; 2) Improved displacement volume stability in the presence of varying ambient temperatures; and 3) Overall stiffness of the base assembly with the fixed links is far better than that of the adjusting screw version.

The improvements with respect to temperature differentials are due to the fact that the plastic links expand and contract in unison with the plastic base such that the angle does not change. The wide difference in thermal coefficients of expansion between the stainless-steel adjusting screw and the plastic base are such that changes in ambient temperature yield significant changes in angle.

Despite the advantages of the fixed link concept, there has been one drawback preventing its wider use in more applications. This drawback is the fact that there is no means for fine adjustment for precise calibration of displacement once the parts have been assembled. There are numerous applications where merely getting close to a target displacement for hundreds or thousands of pumps is not sufficient. Such applications need each and every pump to be individually "tweaked" to arrive at a precise output. Such accuracy must routinely achieve ±1% of the target value. Due to the variations in other components plus slight differences in molded lengths of fixed links, accuracy is generally not better than ±6% of target value.

Accordingly, it would be desirable to provide a means for dealing with the need for slight adjustments to output volume when the fixed link construction is employed.

SUMMARY

In one aspect of the present disclosure, an angle adjustment mechanism for a pump and a motor is provided. The mechanism generally includes a base, an eccentric bushing and a fixed link. The base has a motor flange for mounting a motor, a pump flange opposite the motor flange for mounting a pump, a hinge disposed between the motor flange and the pump flange and a pair of spaced apertures disposed opposite the hinge. The eccentric bushing has a body portion received in one of the apertures of the base and an inner bore with an axial center line offset from an axial center line of the body portion. The fixed link has a first pin portion received in the inner bore of the eccentric bushing and a second pin portion received in the other of the apertures of the base. With this arrangement, rotation of the eccentric bushing changes the distance between the apertures of the base, thereby changing an angle between the motor flange and the pump flange about the hinge.

In a preferred embodiment, the eccentric bushing includes a head portion terminating one end of the body portion for facilitating rotation of the eccentric bushing. The head portion is preferably hexagonal shaped and further preferably includes a notch located at a distance furthest from the center line of the inner bore.

The hinge of the base is preferably a living hinge formed integral with the base.

The fixed link preferably includes a pair of complimentary segments. Each segment has an insertion pin portion and a receptacle pin portion, wherein the insertion pin portion of each segment is received in the receptacle portion of the other segment.

In another aspect of the present disclosure, a motor and pump assembly is provided, wherein a motor is mounted to the motor flange of the base and a pump is mounted to the pump flange of the base. The motor has a shaft rotatable about a rotation axis and the pump has a piston rotatable about a rotation axis and linearly translatable along the rotation axis, wherein the pump piston is coupled to the motor shaft. Rotation of the eccentric bushing changes the distance between the apertures of the base thereby changing an angle between the rotation axis of the motor shaft and the rotation axis of the pump piston about the hinge.

In another aspect of the present disclosure, a method for adjusting the angular orientation between a motor shaft of a motor and a pump piston of a pump is provided. According to the method, a base as described above is provided between the motor and the pump, and the eccentric bushing is rotated within one of the spaced apertures to change an angle between the motor shaft and the pump piston about the hinge.

Thus, an adjustment mechanism is provided, which employs a special bushing having an outer cylindrical diameter for close engagement in an enlarged hole in the lower half of the base. This hole has previously been used to engage a pivot pin for the screw adjustment mechanism and alternatively a round boss on the fixed link. In this aspect of the invention, this hole is enlarged from ¼" to 5/16" to receive the aforementioned bushing. The bushing is provided with a ¼" through hole with its axis parallel to its outer diameter but offset by approximately 0.02". At one end of the bushing is provided a hexagonal flange for engagement of a wrench. Additionally the bushing is provided with a notch to indicate the maximum offset location which is useful in the final calibration "tweaking" of the pump.

The eccentric bushing is assembled into the enlarged hole in the base and the fixed links are assembled into the upper base pivot pin hole and the central offset bore of the eccentric bushing. At final calibration a thin pattern wrench is used to turn the eccentric bushing which causes the lower boss of the plastic link to move either closer to or farther away from its engagement point with the upper portion of the base. The eccentricity of the lower bushing allows for approximately ±10% adjustment in pump output. By this means, extremely precise calibration can be achieved with fixed link pumps. Such pumps can thereby benefit from the excellent advantages of fixed links enumerated above while still achieving the required precision.

In still another aspect of the invention, two eccentric bushings are provided for both coarse and fine adjustment of the pump output. In this aspect, the angle adjustment mechanism includes a base including a motor flange for mounting a motor, a pump flange opposite said motor flange for mounting a pump, a hinge disposed between said motor flange and said pump flange and a pair of spaced apertures disposed opposite said hinge. The angle adjustment mechanism further includes a first eccentric bushing having a body portion received in a first of the apertures of the base, wherein the first eccentric bushing has an inner bore with an axial center line offset from an axial center line of the body portion by a first distance. The angle adjustment mechanism further includes a second eccentric bushing having a body portion received in one of a second of the apertures of the base or the inner bore of the first eccentric bushing, wherein the second eccentric bushing has an inner bore with an axial center line offset from an axial center line of the body portion by a second distance, and wherein the second distance is different from the first distance. A fixed link having a first pin portion received in the first aperture of the base and a second pin portion received in the second aperture of the base is also provided, wherein rotation of the eccentric bushings changes the distance between the apertures of the base, thereby changing an angle between the motor flange and the pump flange about the hinge.

In the embodiment wherein the second eccentric bushing is received in the second aperture of the base, the body portion of the second eccentric bushing preferably has a diameter different from a diameter of the body portion of the first eccentric bushing to help differentiate the different adjustments provided by the first and second bushings. In this regard, one of the first and second offset distances is preferably in the range between 0.015" and 0.050" for coarse adjustment of the distance between the apertures, and the other of the first and second offset distances is preferably in the range between 0.000" and 0.015" for fine adjustment of the distance between the apertures.

In another aspect of the present disclosure, a motor and pump assembly is provided, wherein a motor is mounted to the motor flange of the base and a pump is mounted to the pump flange of the base. The motor has a shaft rotatable about a rotation axis and the pump has a piston rotatable about a rotation axis and linearly translatable along the rotation axis, wherein the pump piston is coupled to the motor shaft. First and second eccentric bushings with different axial offsets are again provided, wherein rotation of the bushings changes the distance between the apertures of the base thereby changing an angle between the rotation axis of the motor shaft and the rotation axis of the pump piston about the hinge.

In a method according to this aspect of the invention, rotation of one of the first and second bushings results in a coarse adjustment of the angular orientation between a motor shaft of a motor and a pump piston of a pump, and rotation of the other of the first and second bushings results in a fine adjustment of the angular orientation between the motor shaft of the motor and the pump piston of the pump.

Features of the disclosure will become apparent from the following detailed description considered in conjunction with the accompanying drawings. It is to be understood, however, that the drawings are designed as an illustration only and not as a definition of the limits of this disclosure.

DETAILED DESCRIPTION

Figure 1:
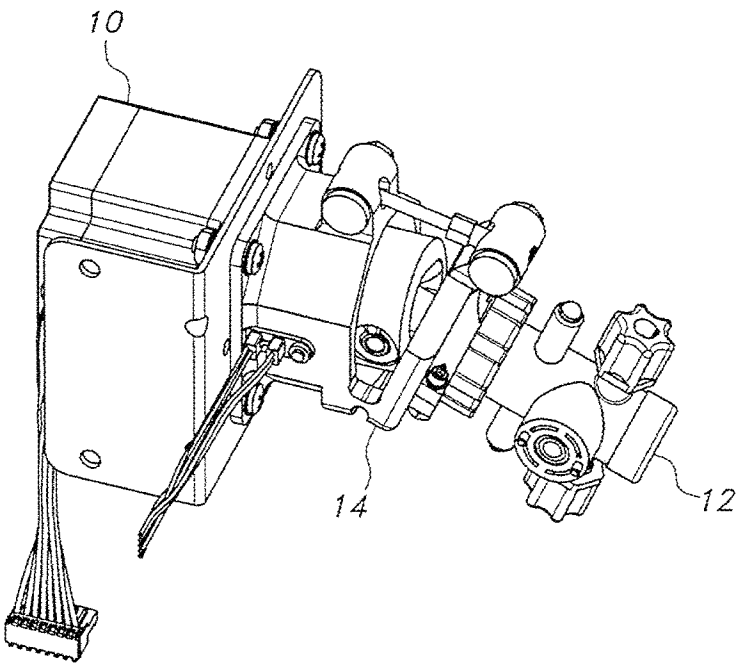
FIG. 1 (PRIOR ART)
FIG. 1 is a perspective view of a conventional motor/pump connection utilizing adjustable flow angle hardware, according to the prior art.

FIG. 1 shows a conventional motor 10 connected to a pump 12 via a base 14. The motor 10 has a shaft that rotates about a rotational axis and the pump has a piston that also rotates about a rotational axis and also translates in the direction of the rotational axis. The shaft of the motor is coupled to the piston of the pump so that rotation of the motor shaft will cause rotation of the pump piston. Also, by tilting the rotational axis of the pump piston with respect to the rotational axis of the motor shaft, rotation of the motor shaft will also cause linear translation of the pump piston in a manner as described in further detail below. A pump and motor support arrangement of this type is shown and described in commonly owned U.S. Pat. Nos. 4,941,809 and 5,020,980, the specifications of which are incorporated herein by reference in their entirety for all purposes.

Such pump and motor arrangement operates as follow. The motor shaft of the motor 10 is coupled to a piston of the pump 12. Each rotation of the motor shaft rotates the piston of the pump. Due to the angular orientation between the pump and the motor, each rotation of the motor shaft further causes the pump piston to reciprocate in the axial direction to alternately draw in and push out fluid so as to transfer fluid between an inlet and an outlet of the pump. The amplitude of the piston stroke determines the volume of the fluid delivered between the inlet and the outlet of the pump. By varying the angle of the pump with respect to the motor, the stroke of the piston is adjusted, thereby adjusting the volume of the fluid transferred between the inlet and the outlet.

In such prior art pump and motor arrangements, the angle of the pump 12 with respect to the motor 10 is adjustable via the base 14 to provide a desired volumetric flow of the pump with each rotation of the motor shaft of the motor. Therefore, it is desirable to provide a base 14 which is adapted for adjusting the angles between the axis of the pump and the motor shaft of the motor.

FIG. 1 shows one prior art embodiment of an adjustable base 14, which includes a flange to which the motor 10 is mounted and an opposite flange to which the pump 12 is mounted. Between the two flanges is a flexible living hinge, which allows angular pivoting of the flanges with respect to the hinge. Opposite the hinge are two bosses, between which adjustable flow angle hardware is provided. In the embodiment shown in FIG. 1, the adjustable flow angle hardware is in the form of a screw and nut arrangement connected between pivot pins inserted in the respective bosses of the base. Rotation of the nut with respect to the screw is done to secure the unthreaded pivot pin so that it cannot turn after adjustment is made. The nut is loosened when it is desired to turn the screw. By insertion of a hex key into the screw head, it is possible to turn the screw such that it moves in and out of the threaded lower pivot pin. This action selectively lengthens or shortens the length between the pivot pins of the bosses, thereby adjusting the angle of the motor flange with respect to the pump flange.

However, some of the disadvantages of such arrangement include problems with thermal expansion of the differing materials depending on the work environment. The adjustable screw arrangement is also less stable and is prone to loosening, wherein the angle will be undesirably altered. This arrangement also involves numerous components making assembly complex, and resulting in increased cost.

Figure 2:
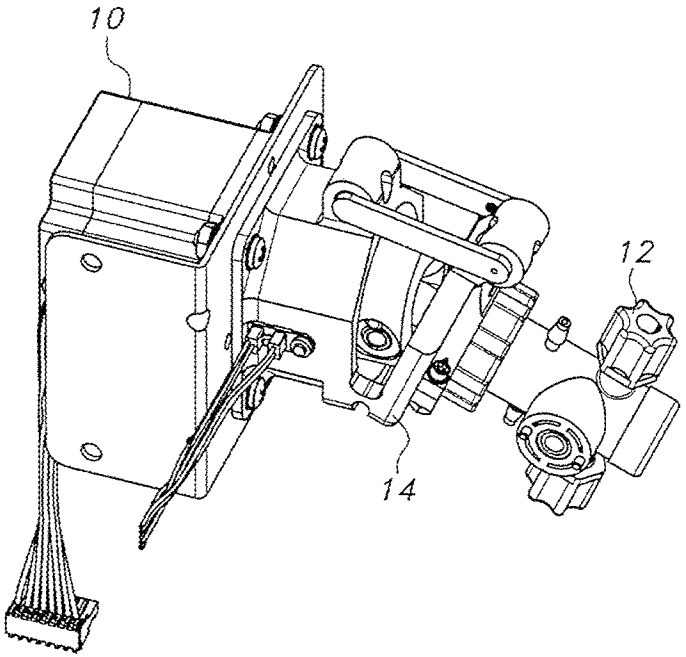
FIG. 2 (PRIOR ART)
FIG. 2 is a perspective view of a conventional motor/pump connection utilizing a fixed link, according to the prior art.

FIG. 2 shows an alternative embodiment of a motor/pump connection of the prior art utilizing a base, similar to the base shown in FIG. 1, but utilizing a fixed link provided between the opposing bosses. Specifically, the base 14 shown in FIG. 2 again includes a motor mounting flange and a pump mounting flange on opposite sides of a flexible living hinge. Opposite the hinge are opposed bosses between which a fixed link is provided to set the angle between the pump and the motor. The length of the fixed link is selected based on the desired volumetric flow produced by the pump. In certain applications, a variety of fixed links of differing lengths can be provided to adjust the volume of the pump in a predetermined range.

Figure 3:
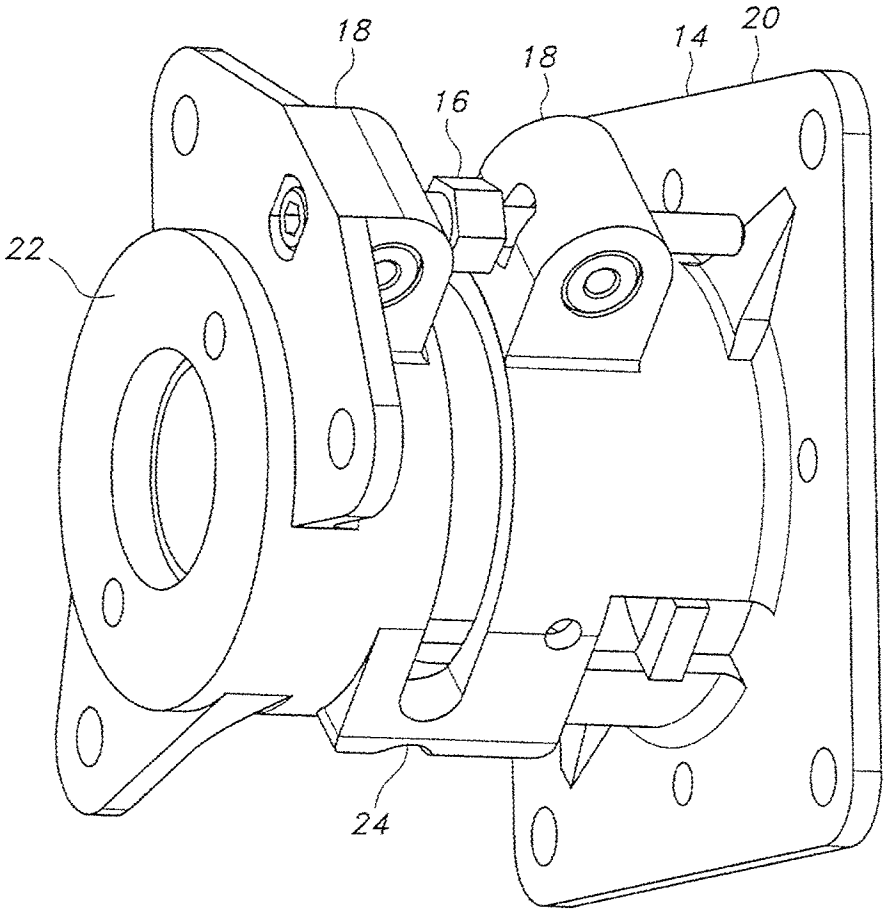
FIG. 3 (PRIOR ART)
FIG. 3 is an isolated view of the base of a conventional motor/pump base utilizing adjustable flow angle hardware, according to the prior art.

FIG. 3 shows in further detail an adjustable screw and nut arrangement, similar to that shown in FIG. 1. It can be seen in FIG. 3 how rotation of the nut 16 with respect to the screw will secure the unthreaded pivot pin so that it cannot turn after adjustment is made. The nut is loosened when it is desired to turn the screw. By insertion of a hex key into the screw head, it is possible to turn the screw such that it moves in and out of the threaded lower pivot pin. This action will either lengthen or shorten the distance between the pivot pins provided within the respective bosses 18. Lengthening or shortening of the distance between the bosses 18 will, in turn, change the angle between the motor mounting flange 20 and the pump mounting flange 22 due to the resultant bending of the flexible hinge 24.

Figure 4:
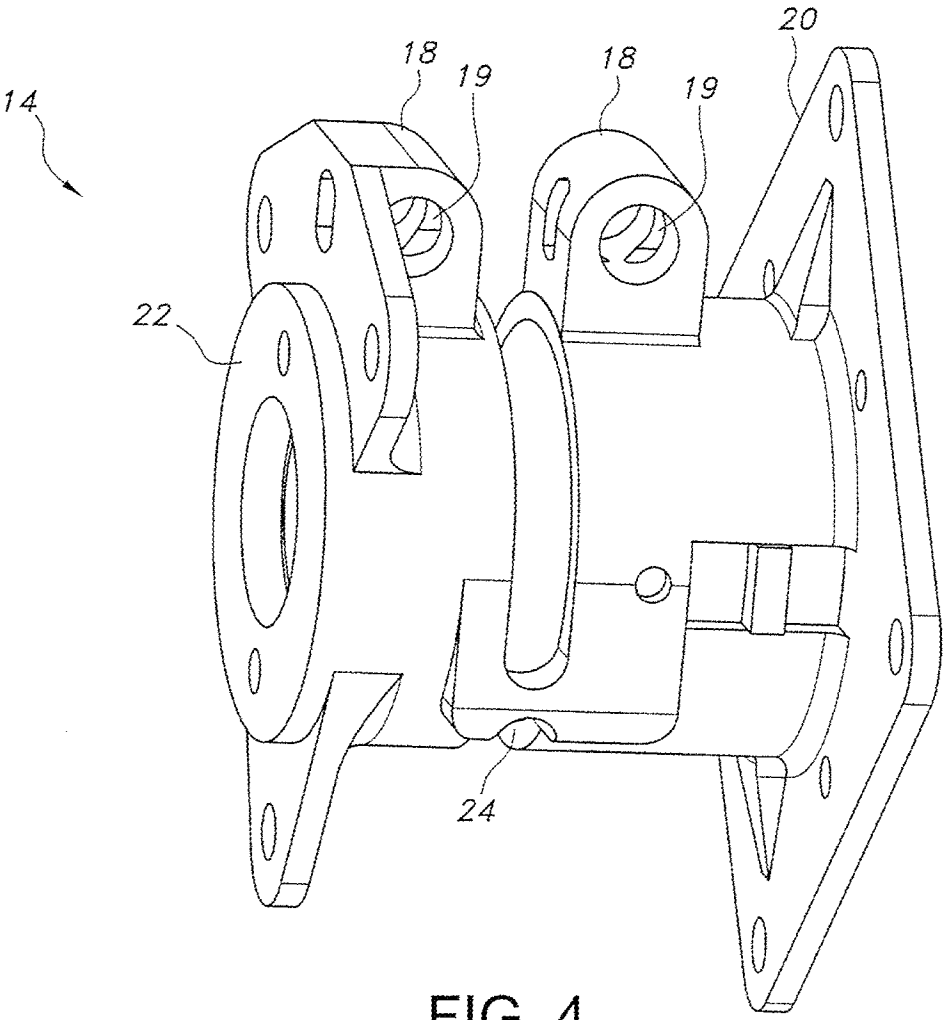
FIG. 4 (PRIOR ART)
FIG. 4 is an isolated perspective view of the base alone, according to the prior art.

FIG. 4 shows a base 14 of the prior art without the adjustment mechanism. It can be appreciated how the base 14 shown in FIG. 4 might be used in either of the two prior art embodiments described above, and can further be used with the present invention, as will be discussed in further detail below. The base 14 is made of an injection molded plastic and includes a motor mounting flange 20, the bosses 18 having apertures 19 formed therein, a pump mounting flange 22 and a living hinge 24 provided opposite the bosses.

Figure 5:
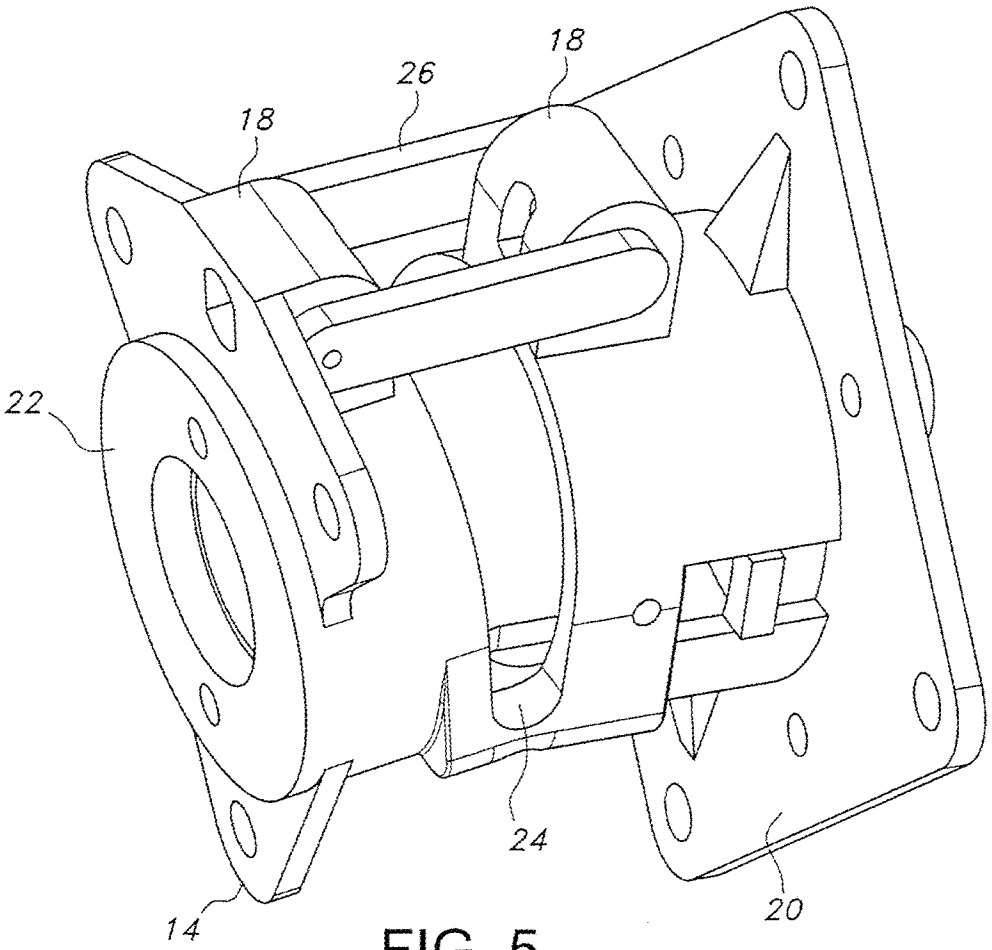
FIG. 5 (PRIOR ART)
FIG. 5 is an isolated perspective view of the base utilizing a fixed link, according to the prior art.

FIG. 5 shows a base 14 of the prior art, as described above, and further including a fixed link 26 for setting the distance between the bosses 18 thereby setting the angle between the motor flange 20 and the pump flange 22 with respect to the living hinge 24.

Figure 6:
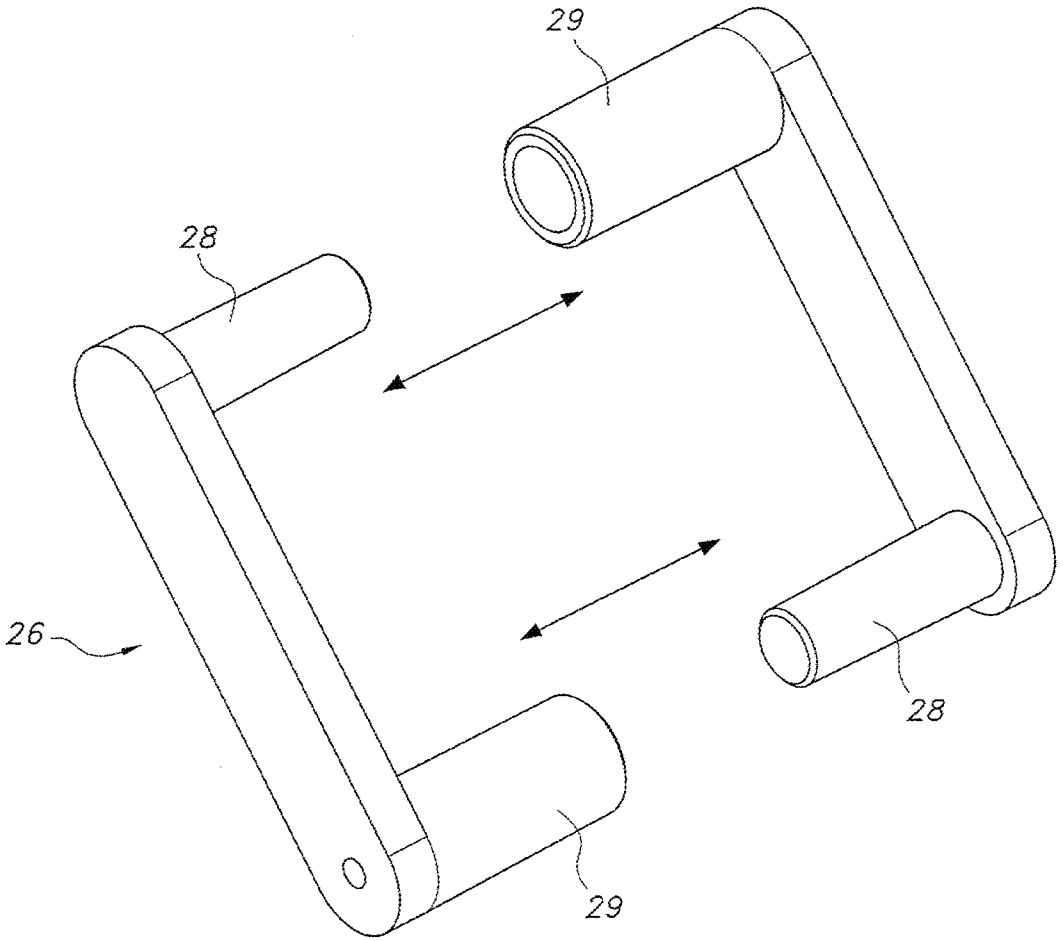
FIG. 6 (PRIOR ART)
FIG. 6 is an isolated perspective view of two components of a fixed link of the prior art.

As shown in more detail in FIG. 6, the link 26 preferably includes a pair of injection molded complimentary segments, wherein each link segment includes an insertion pin portion 28 received within a matching sized pin receptacle portion 29 of the opposite link segment. The pin receptacle portions 29 of each link are sized to be interference fit within a correspondingly sized hole in a respective boss 18 of the base 14. Again, the length between the pin portion 28 and the pin receptacle portion 29 of each link 26 determines the angle between the pump and the motor.

Thus, a variety of fixed links 26 having different lengths can be provided with the base 14 shown in FIG. 5 for setting varying lengths between the bosses 14. The differing lengths will cause the hinge 24 to pivot about its pivot point at different angles, so that a desired pump to motor angle can bet set.

The benefits with the fixed linked systems shown in FIGS. 2, 5 and 6, include increased stability of the base with less sensitivity to thermal expansion. However, due to tolerances in injection molding and tolerances between the pump and the motor themselves, an exact desired volume flow rate is not always achieved despite a proper selection of the link length. Thus, it would be desirable to have all of the benefits of a fixed link, with the added benefit of adjustment of the length of the fixed link.

Figure 7:
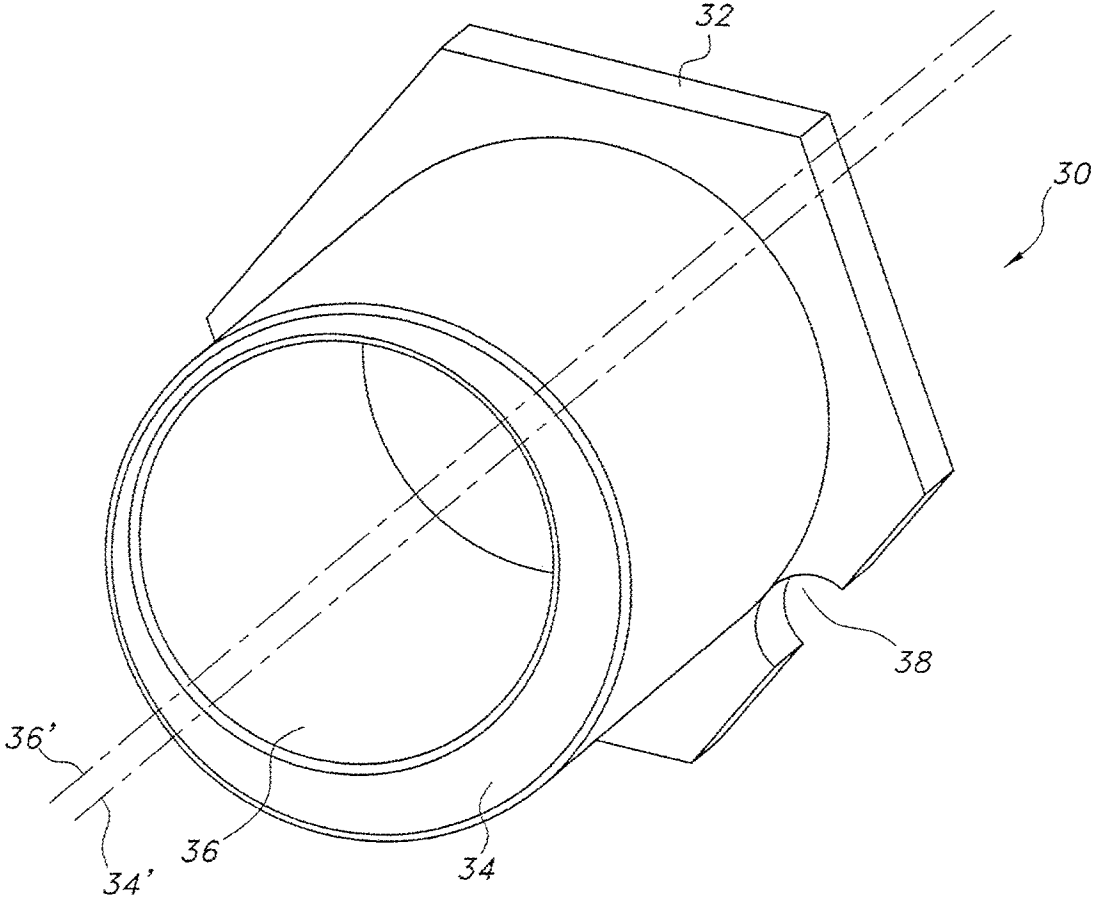
FIG. 7 is a perspective view of an eccentric bushing formed in accordance with the present invention.
Figure 8:
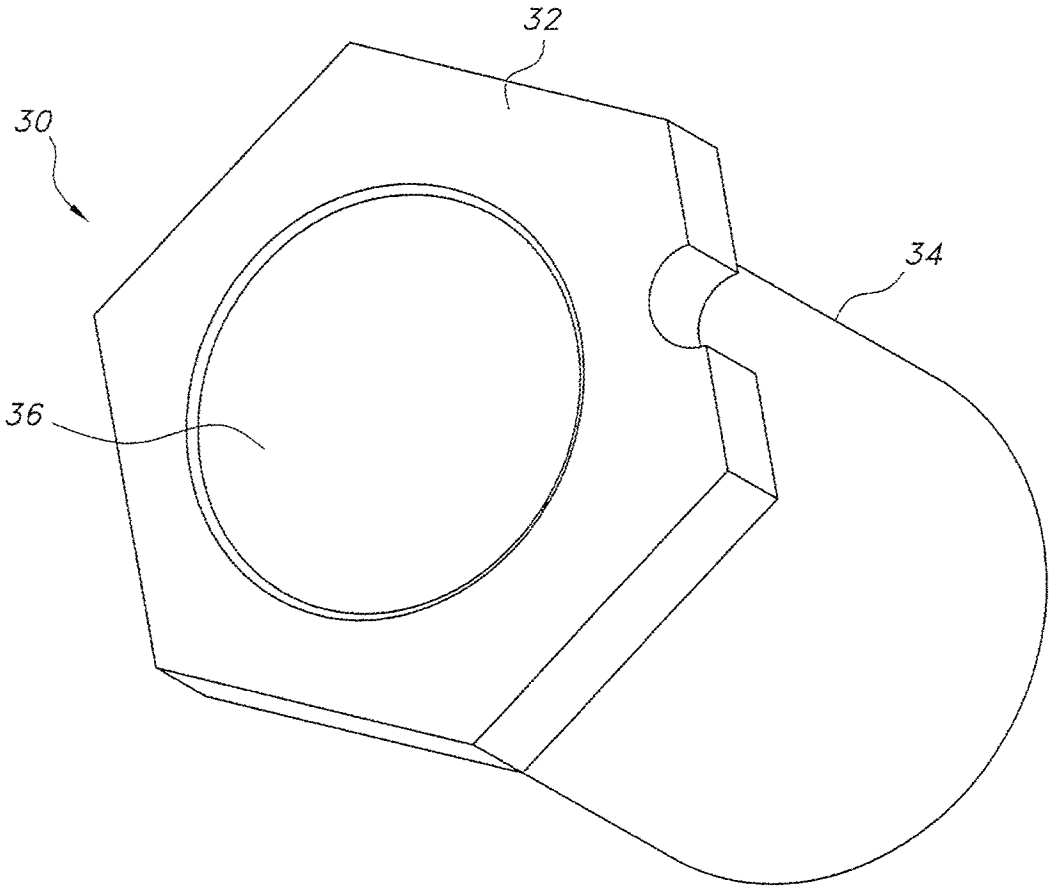
FIG. 8 is a rear perspective view of the eccentric bushing shown in FIG. 7.

Accordingly, the present invention provides a fixed link arrangement with adjustability of the length between the apertures 19 of the respective bosses 18 of the base 14. This is achieved by providing an eccentric bushing 30, as shown in FIGS. 7 and 8, received within one or both of the apertures 19 of the base bosses 18.

The eccentric bushing 30 of the present invention includes a head portion 32 and a body portion 34 extending in coaxial relation with the head portion. The head portion 32 is preferably hexagonal shaped for purposes which will be described later. The body portion 34 is preferably cylindrically shaped and has an outer diameter sized to be interference fit within at least one of the through holes 19 provided in the bosses 18 of the base 14. The length of the body portion 34 is also preferably selected to match the length of the through hole 19 provided in the respective boss 18 of the base.

Formed axially in the body portion 34 and the head portion 32 is a bore 36 extending the length of the bushing 30. The bore 36 has an axial center line 36' off set from the axial center line 34' of the body portion 34. In other words, the center line 36' of the bore 36 is not coaxial with the center line 34' of the body portion 34. Thus, the bushing 30 has an axial through hole 36 formed in an eccentric relation with the outer diameter of the body portion 34 so that rotation of the body portion about its axial center line 34' will cause the axial centerline 36' to revolve around the axial center line 34' of the body portion.

Figure 9:
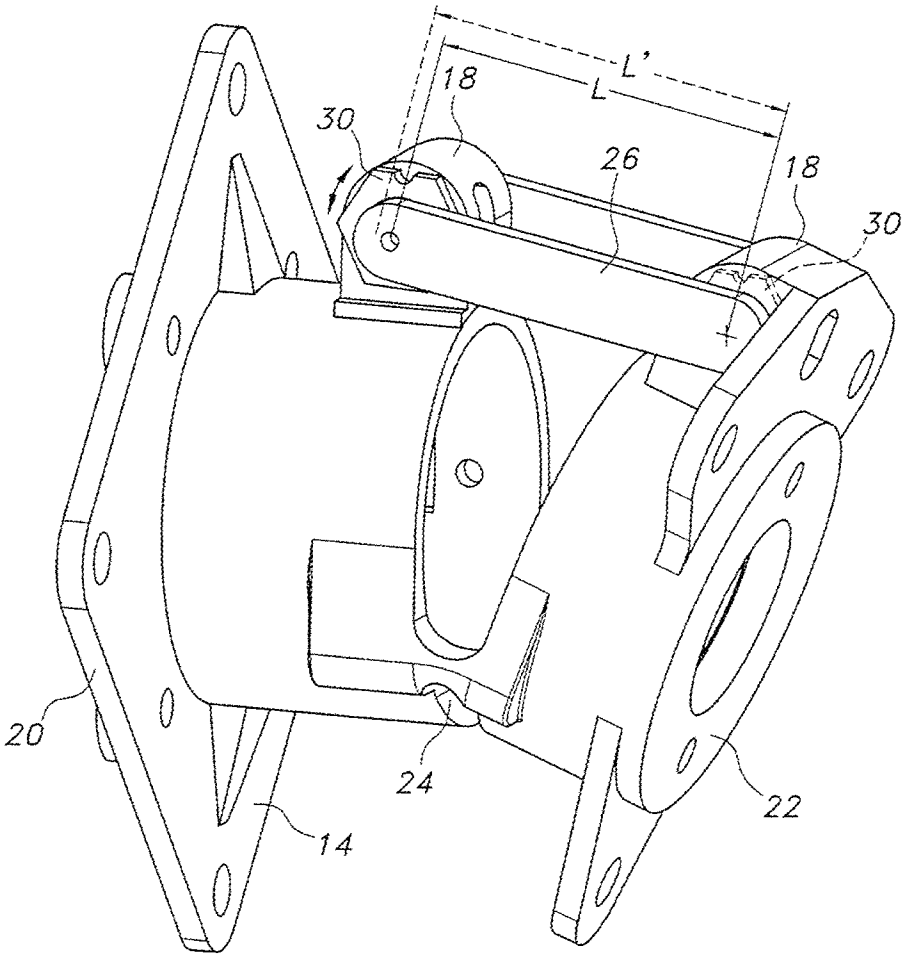
FIG. 9 a perspective view of the motor/pump base formed in accordance with the present invention.
Figure 10:
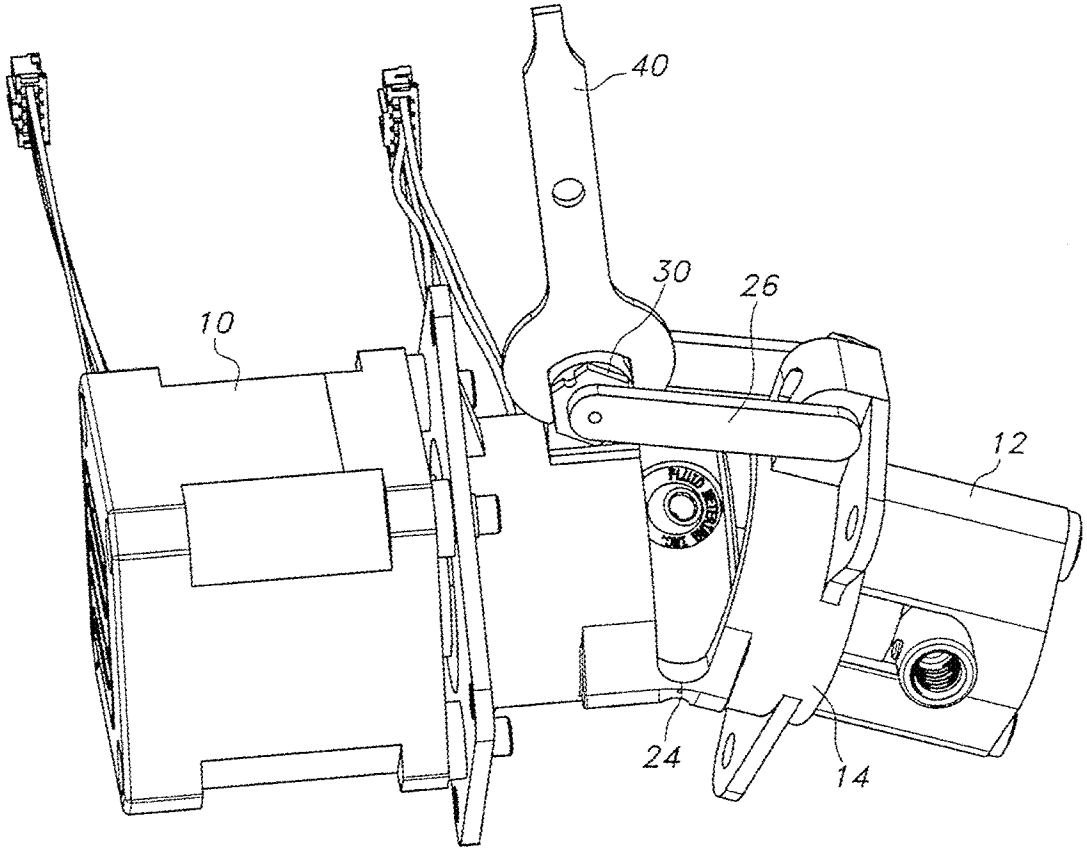
FIG. 10 is a perspective view of the motor/pump base formed in accordance with the present invention attached to a motor and a pump, wherein the displacement length is being adjusted by a wrench.

The eccentric axial through hole 36 has an inner diameter sized to receive one of the pin receptacle portions 29 of the fixed link 26, (shown in FIG. 6), in an interference or a press fit relationship. Thus, as shown in FIGS. 9 and 10, with the eccentric bushing 30 inserted in a through hole 19 of the boss 18 it can be seen how rotation of the bushing 30 with respect to the boss 18 will change the location of the inner bore 36 of the bushing with respect to the through hole 19 of the boss 18. By changing the axial location of the receptacle pin portion 29 of the fixed link 26 with respect to the axial center of the body portion of the bushing, it can be appreciated how the distance between the opposite bosses 18 of the base 14 can effectively change by virtue of the fixed link.

Specifically, rotation of the bushing 30 within the aperture 19 of the boss 18 will cause the axial center line 36' of the inner bore 36 to change its position. However, because the length of the fixed link 26 is fixed, rotation of the eccentric bushing will have a cam effect on the boss 18 in which it is received, thereby causing the spacing between the apertures of the bosses to change from L to L', as shown in FIG. 9. By changing this distance, the hinge 24 is forced to flex open or closed to thereby change the angular orientation between the pump flange 22 and the motor flange 20.

The hexagonal shape of the head 32 of the bushing 30 also facilitates application of a wrench 40 to aid in rotation of the bushing 30. The head portion 32 of the bushing 30 is also preferably provided with a notch 38 so as to provide a visual indication of the maximum displacement of the through hole 36 with respect to the body portion 34. Thus, the notch 38 is preferably provided on the head portion 32 at a location that is furthest from the center line 36' of the inner bore 36.

An improvement of the above described adjustment methods is to provide finer resolution of the angle change to such a degree where repeatable, sub-microliter flow adjustment can be made on demand while having the benefits of the fixed link concept. This improvement is realized by providing two eccentric bushings for both a fine adjustment and a coarse adjustment to meet variations in flow less than 1% of target flow for applications where sub-microliter variation is needed. Also, maximizing the adjustable flow range of the fixed pump design increases the adaptably of a single pump design, allowing the same design to be used in different roles for the same customer application.

Figure 11:
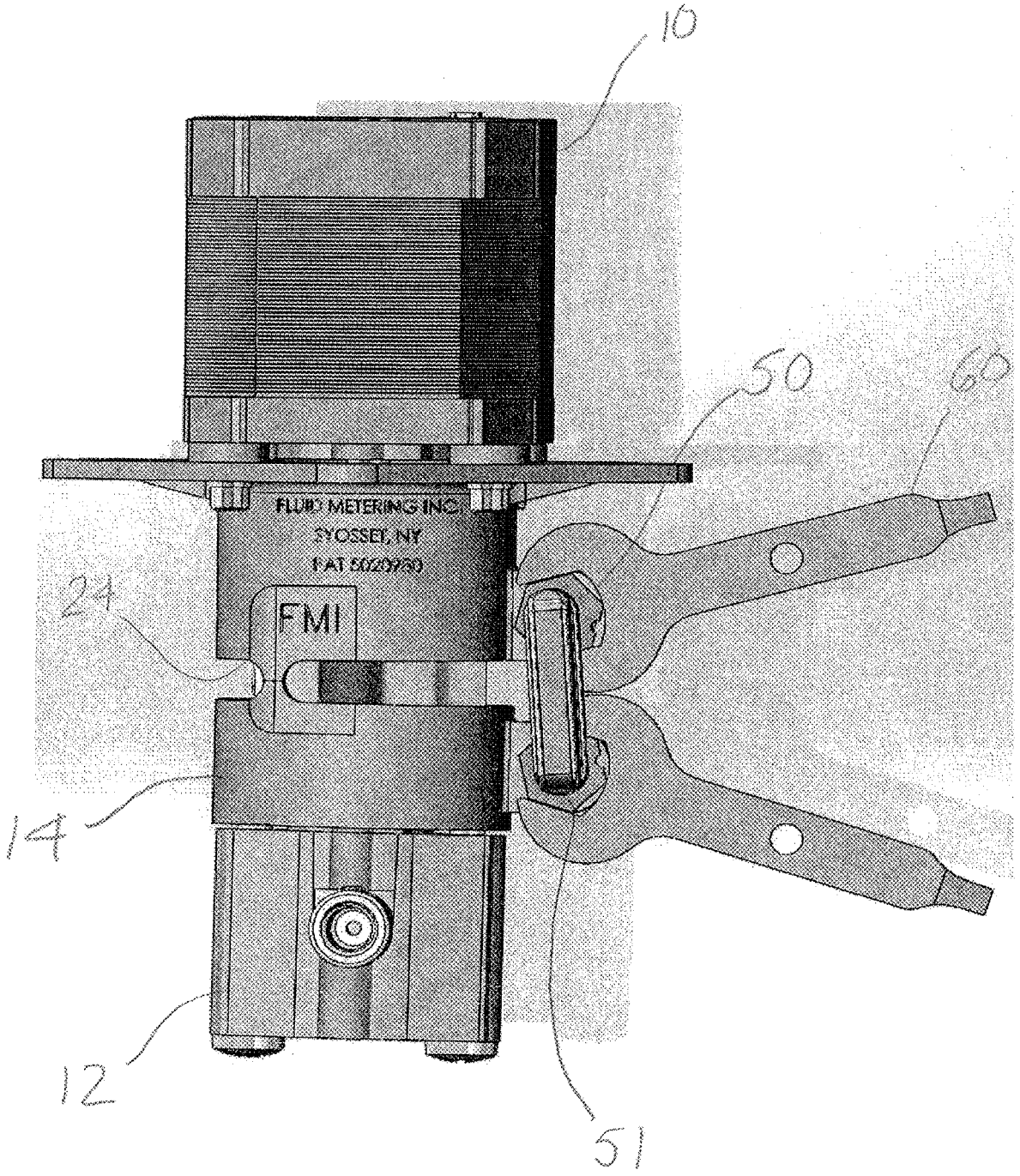
FIG. 11 is a side view of the motor/pump base formed in accordance with an alternative embodiment of the present invention attached to a motor and a pump, wherein the displacement length is being adjusted via a coarse adjustment and a fine adjustment.
Figure 12:
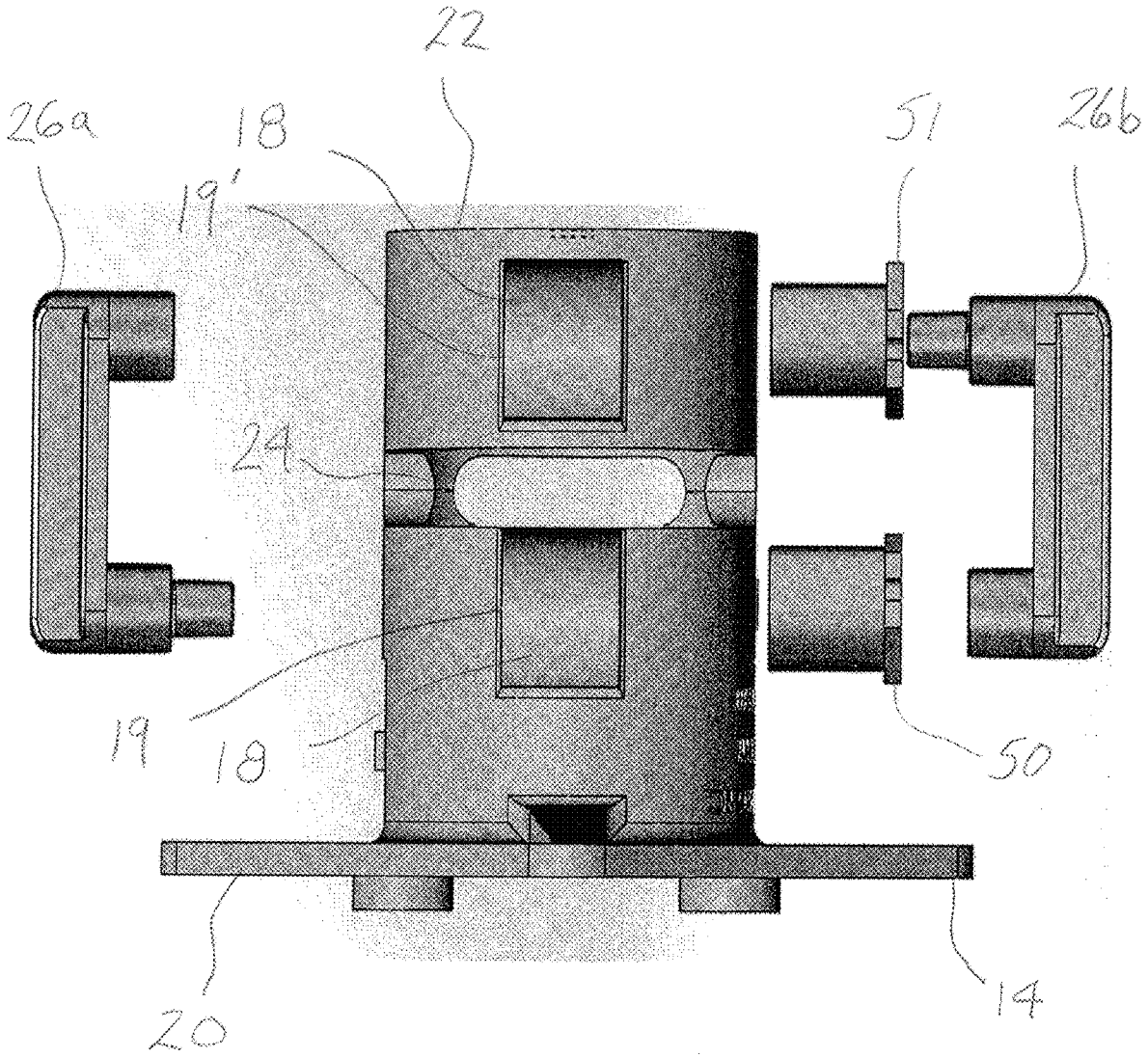
FIG. 12 is an exploded front view of the motor/pump base assembly shown in FIG. 11.
Figure 13:
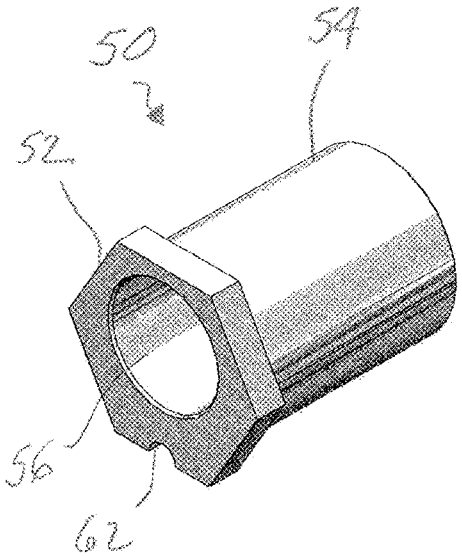
FIG. 13 is a perspective view of the eccentric coarse adjustment bushing shown in FIGS. 11 and 12.
Figure 14:
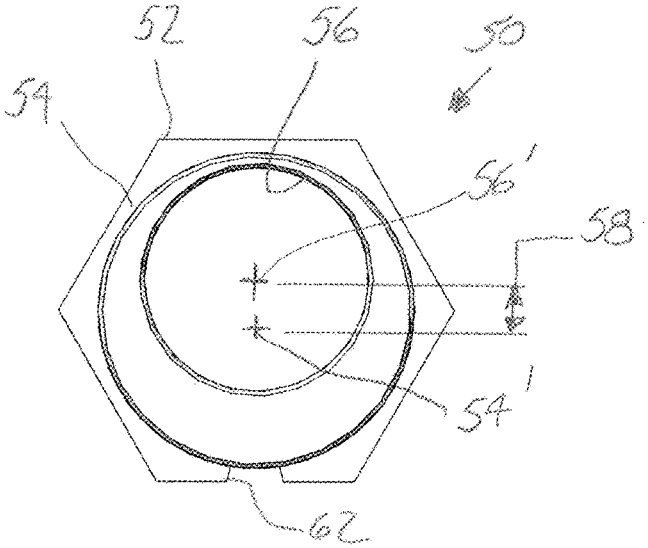
FIG. 14 is an end view of the coarse adjustment bushing shown in FIG. 13.
Figure 15:
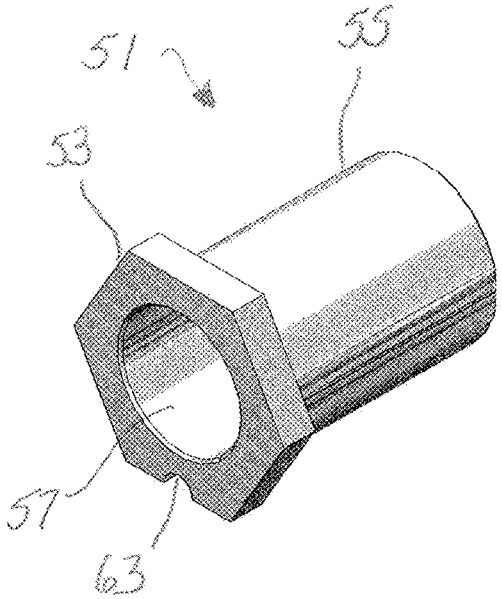
FIG. 15 is a perspective view of the eccentric fine adjustment bushing shown in FIGS. 11 and 12.
Figure 16:
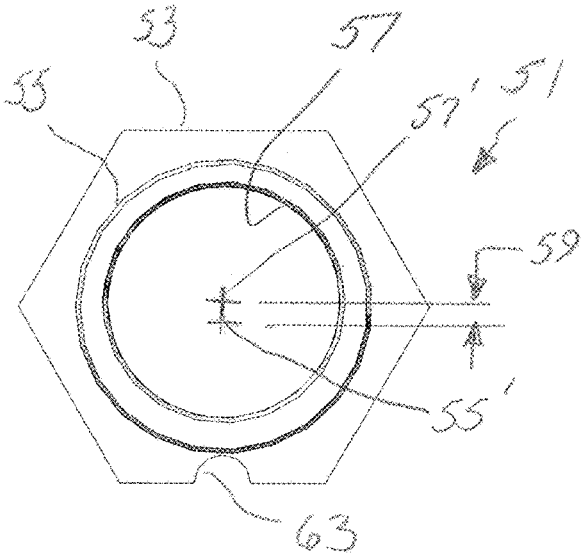
FIG. 16 is an end view of the fine adjustment bushing shown in FIG. 15.

Thus, as shown in FIGS. 11 and 12, an eccentric bushing is received in each of the apertures of the bosses of the flexible base to thereby provide even greater adjustability. The embodiment shown in FIGS. 11 and 12 is similar to that described above in that a conventional motor 10 is connected to a pump 12 via a flexible base 14. As described above, by varying the angle of the pump with respect to the motor, via the flexible hinge 24 of the base 14, the stroke of the piston is adjusted, thereby adjusting the volume of the fluid transferred between the inlet and the outlet.

As also described above, the base 14 includes a motor mounting flange 20, bosses 18 having apertures 19, 19' formed therein, a pump mounting flange 22 and a living hinge 24 provided opposite the bosses and between the flanges. A fixed link pair 26*a*, 26*b* is also provided for setting the distance between the bosses 18, as described above, to thereby set the angle between the motor flange 20 and the pump flange 22 with respect to the living hinge 24.

However, in this aspect of the invention, two different eccentric bushings 50, 51 are provided for coarse and fine adjustment of the angle between the motor flange and the pump flange. A large eccentric bushing 50, for coarse adjustment, is received in the aperture 19 of the boss 18 closer to the motor flange 20 and a smaller eccentric bushing 51, for fine adjustment, is received in the aperture 19' of the boss 18 located closer to the pump flange 22 of the base 14.

Referring additionally to FIGS. 13-16, each eccentric bushing 50, 51 includes a head portion 52, 53 and a body portion 54, 55 extending in coaxial relation with the head portion. The head portion 52, 53 is preferably hexagonal shaped for purposes which will be described later. The body portion 54, 55 is preferably cylindrically shaped and has an outer diameter sized to be interference fit within the through holes 19, 19' provided in the bosses 18 of the base 14. The length of the body portion 54, 55 is also preferably selected to match the length of the through hole 19, 19' provided in the respective boss 18 of the base.

In order to differentiate between the large eccentric bushing 50 and the small eccentric bushing 51 during both assembly and operation of the pump, two differently sized through holes 19, 19' are preferably provided in their respective bosses 18. For example, the through hole 19 for the large eccentric bushing 50 has a diameter of 11/32", while the diameter of the through hole 19' for the small eccentric bushing 51 has a diameter of 5/16". In this manner, coarse adjustment can be achieved by rotating the bushing adjacent the motor and fine adjustment can be achieved by rotating the bushing adjacent the pump.

Formed axially in the body portion 54, 55 and the head portion 52, 53 of each bushing 50, 51 is a bore 56, 57 extending the length of the bushing. Each bore 56, 57 has an axial center line 56', 57' off set from the axial center line 54', 55' of the respective body portion 54, 55. Thus, as described above, the center line 56', 57' of the respective bore 56, 57 is not coaxial with the center line 54', 55' of its respective body portion 54, 55. Thus, as described above, each bushing 50, 51 has an axial through hole 56, 57 formed in an eccentric relation with the outer diameter of its respective body portion 54, 55 so that rotation of the body portion about its axial center line 54', 55' will cause the axial centerline 56', 57' of the bore 56, 57 to revolve around the axial center line 54', 55' of the body portion.

However, in this embodiment, the offset 58 between the centerline 56' of the bore 56 and the centerline 54' of the body portion 54 of the larger eccentric bushing 50 is greater than the offset 59 between the centerline 57' of the bore 57 and the centerline 55' of the body portion 55 of the small eccentric bushing 51. Thus rotation of the large bushing 50 about the body portion center line 54' will result in greater axial displacement of the bore center line 56', as compared with the small bushing 51. As a further result, a "coarse" angle adjustment, (e.g., angle adjustments greater than 0.5°), is achieved with the large bushing 50 and a "fine" angle adjustment (e.g., angle adjustments less than) 0.5°, is achieved with the small bushing 51.

The offset 58 between the centerline 56' of the bore 56 and the centerline 54' of the body portion 54 of the larger eccentric bushing 50 is preferably about 0.035", but can fall in the range between 0.015" and 0.050". The offset 59 between the centerline 57' of the bore 57 and the centerline 55' of the body portion 55 of the small eccentric bushing 51 is preferably about 0.005", but can fall in the range between 0 and 0.015".

The eccentric axial through hole 56, 57 of each bushing 50, 51 has an inner diameter (e.g., ¼") sized to receive one of the pin receptacle portions 29 of the fixed link 26, (shown in FIGS. 6 and 12), in an interference or a press fit relationship. As also described above, each bushing 50, 51 is also preferably provided with a notch 62, 63 so as to provide a visual indication of the maximum displacement of the through hole with respect to the body portion. Thus, the notch 62, 63 is preferably provided on the head portion at a location that is furthest from the center line of the inner bore.

Thus, as shown in FIG. 11, with the eccentric bushings 50, 51 inserted in their respective through holes 19, 19' of the bosses 18 it can be seen how rotation of the bushings 50, 51, (with a wrench 60), with respect to the boss will change the location of the inner bore of each bushing with respect to the through hole of the boss. Thus, it can be appreciated how the distance between the opposite bosses 18 of the base 14 can effectively change by virtue of the fixed link, in a manner similar to that described above with respect to FIG. 9.

When a pump flow rate is adjusted, the large (coarse) bushing 50 is rotated for larger flow rate alterations (approximately 1-10% of the nominal flow), while the small (fine) bushing 51 is used for less than 1% flow adjustment. This dual design allows both a larger adjustment range than the single bushing design as well as more refinement across the possible output range. This is especially necessary when sub-microliter alterations are required, expanding the capability of the pump in "low-flow" applications. Also, this allows for the same pump design to be used in applications where multiple pumps are required with differing sub-microliter accuracy requirements are necessary.

In another aspect of the fine/coarse adjustment concept, two different eccentric bushings can be provided, wherein one bushing is nested within the other. Thus, as shown in FIGS. 17 and 18, a large eccentric bushing is received in one of the apertures of the bosses of the flexible base and a small eccentric bushing is received within the inner bore of the large eccentric bushing to thereby provide both fine and coarse adjustability.

Figure 17:
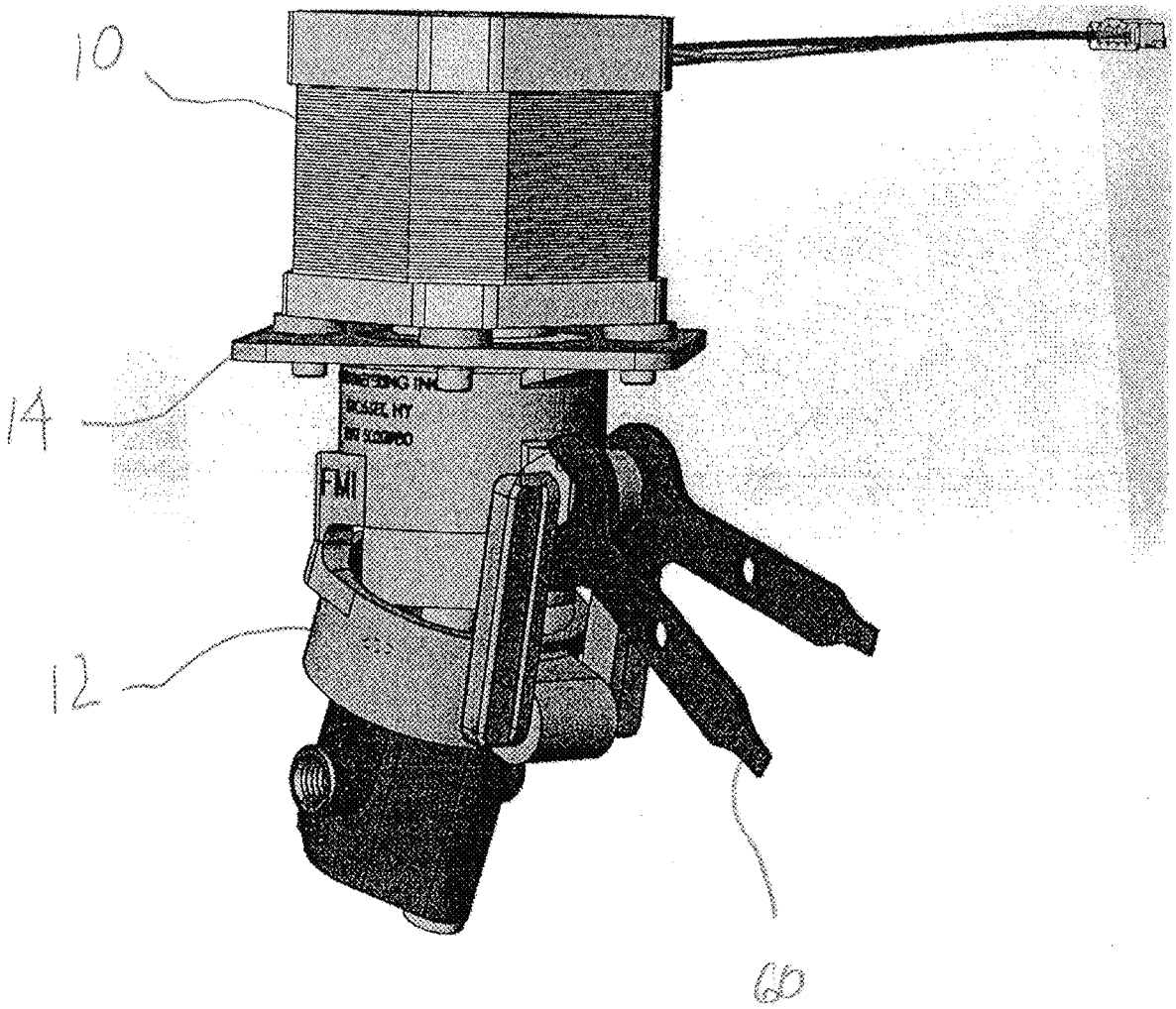
FIG. 17 is a perspective view of the motor/pump base formed in accordance with another alternative embodiment of the present invention attached to a motor and a pump, wherein the displacement length is being adjusted via a coarse adjustment and a fine adjustment.
Figure 18:
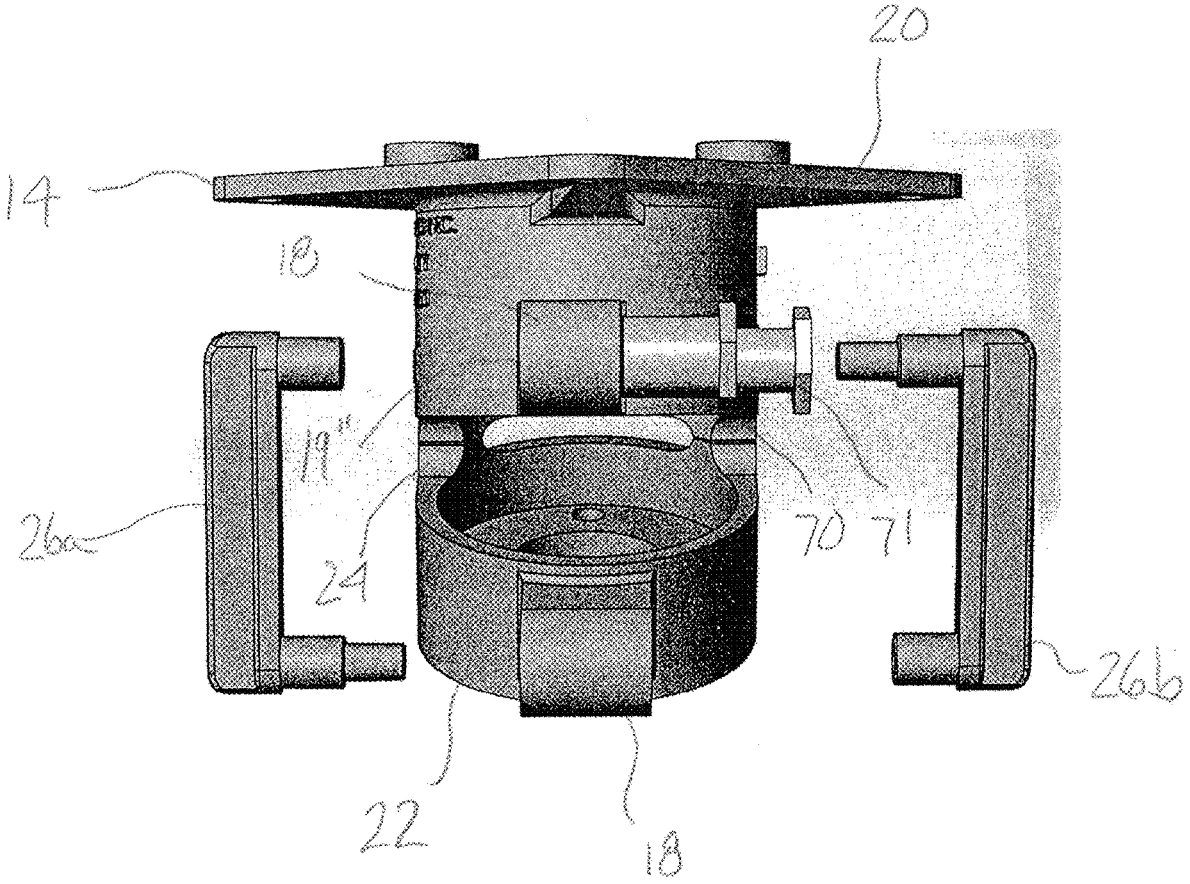
FIG. 18 is an exploded front view of the motor/pump base assembly shown in FIG. 17.
Figure 19:
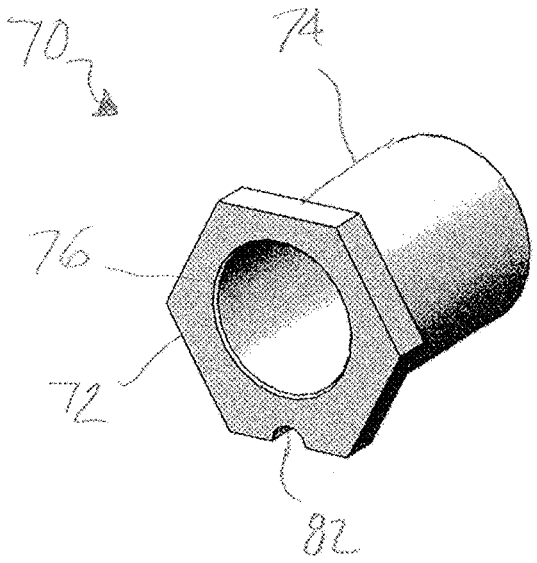
FIG. 19 is a perspective view of the eccentric coarse adjustment bushing shown in FIGS. 17 and 18.
Figure 20:
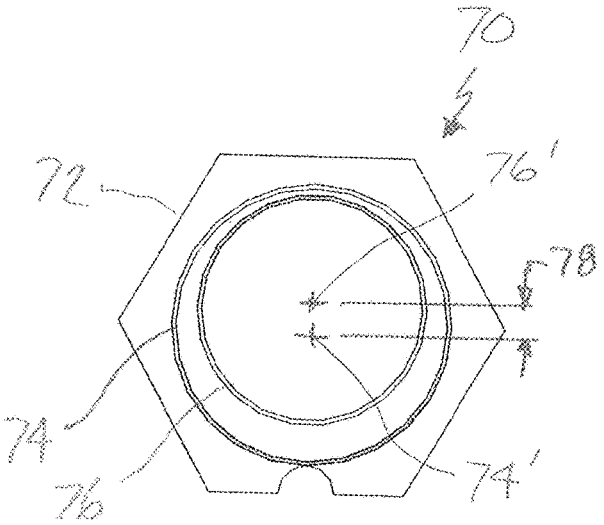
FIG. 20 is an end view of the coarse adjustment bushing shown in FIG. 19.
Figure 21:
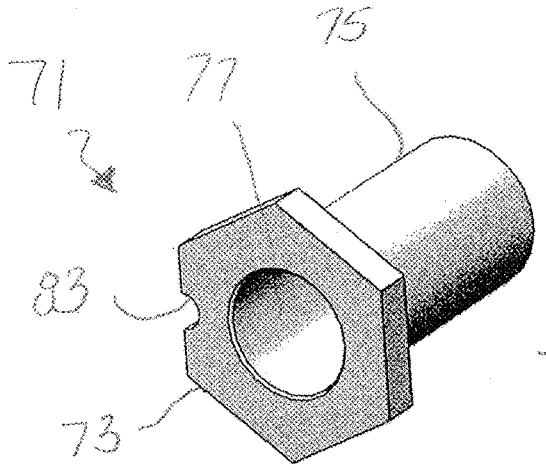
FIG. 21 is a perspective view of the eccentric fine adjustment bushing shown in FIGS. 17 and 18.
Figure 22:
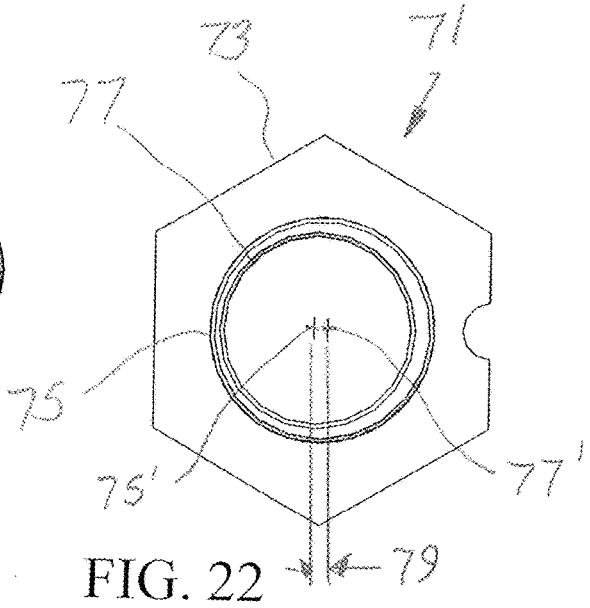
FIG. 22 is an end view of the fine adjustment bushing shown in FIG. 21.

The embodiment shown in FIGS. 17 and 18 is similar to that described above and, therefore, the same reference numerals are used to identify identical components. Specifically, the angle between a conventional motor 10 and a pump 12 is adjustable via a flexible base 14 having a motor mounting flange 20, bosses 18 having apertures 19" formed therein, a pump mounting flange 22 and a living hinge 24 provided opposite the bosses and between the flanges. Also a fixed link pair 26*a*, 26*b* is also provided for setting the distance between the bosses 18, as described above, to thereby set the angle between the motor flange 20 and the pump flange 22 with respect to the living hinge 24.

However, in this aspect of the invention, two different eccentric bushings 70, 71 are provided for coarse and fine adjustment of the angle between the motor flange and the pump flange, wherein the small bushing 71 is received within the outer bushing 70 and the large eccentric bushing 70 can be received within either aperture 19" of the bosses.

Referring additionally to FIGS. 19-22, each eccentric bushing 70, 71 includes a head portion 72, 73 and a body portion 74, 75 extending in coaxial relation with the head portion. The head portion 72, 73 is preferably hexagonal shaped and the body portion 74, 75 is preferably cylindrically shaped, as described above. The outer diameter of the large eccentric bushing 70 is sized to be interference fit within either or both of the through holes 19" provided in the bosses 18 of the base 14.

Formed axially in the body portion 74, 75 and the head portion 72, 73 of each bushing 70, 71 is a bore 76, 77 extending the length of the bushing. The bore 76 of the large bushing 70 is sized to receive the body portion 75 of the small bushing 71 and the bore 77 of the small bushing 71 is sized to receive sized to receive one of the pin receptacle portions 29 of the fixed link 26, (shown in FIGS. 6, 12 and 18), in an interference or a press fit relationship. For example, the body portion 74 of the large bushing 70 can have a diameter of 5/16" and the inner bore 76 can have an inner diameter of ¼". The body portion 75 of the small bushing 71 can have a diameter of ¼" and the inner bore 77 can have an inner diameter of 0.208".

Similar to that described above, each bore 76, 77 has an axial center line 76', 77' off set from the axial center line 74', 75' of the respective body portion 74, 75. In this way, the center line 76', 77' of the respective bore 76, 77 is not coaxial with the center line 74', 75' of its respective body portion 54, 55. To enable fine and coarse adjustment, the offset 78 between the centerline 76' of the bore 76 and the centerline 74' of the body portion 74 of the larger eccentric bushing 70 is greater than the offset 79 between the centerline 77' of the bore 77 and the centerline 75' of the body portion 75 of the small eccentric bushing 71. Thus rotation of the large bushing 70 about the body portion center line 74' will result in greater axial displacement of the bore center line 76', as compared with the small bushing 71.

For example, the offset 78 between the centerline 76' of the bore 76 and the centerline 74' of the body portion 74 of the larger eccentric bushing 70 is preferably about 0.035", but can fall in the range between 0.015" and 0.050". The offset 79 between the centerline 77' of the bore 77 and the centerline 75' of the body portion 75 of the small eccentric bushing 71 is preferably about 0.005", but can fall in the range between 0 and 0.015". It is also conceivable to provide the larger offset 78 (i.e., coarse adjustment) on the small bushing 71 and the smaller offset 79 (i.e., fine adjustment) on the large bushing 70.

As also described above, each bushing 70, 71 is also preferably provided with a notch 82, 83 so as to provide a visual indication of the maximum displacement of the through hole with respect to the body portion. Thus, the notch 82, 83 is preferably provided on the head portion at a location that is furthest from the center line of the inner bore.

Returning to FIGS. 17 and 18, with the eccentric bushings 70, 71 nested together, it can be seen how rotation of the bushings 70, 71, (with a wrench 60), with respect to each other and the boss will change the location of the inner bore of each bushing with respect to the through hole of the boss. The bushings 70, 71 can be nested so that the head portions are on opposite axial ends of the boss, as shown in FIG. 17, or the bushings can be nested so that the head portions face the same axial end of the boss, as shown in FIG. 18.

While various embodiments of the present invention are specifically illustrated and/or described herein, it will be appreciated that modifications and variations of the present invention may be effected by those skilled in the art without departing from the spirit and intended scope of the invention.

What is claimed is:

1. An angle adjustment mechanism for a pump and a motor comprising:

a base including a motor flange for mounting a motor, a pump flange opposite said motor flange for mounting a pump, a hinge disposed between said motor flange and said pump flange and a pair of spaced apertures disposed opposite said hinge;

a first eccentric bushing having a body portion rotatably secured in a first of said apertures of said base, said first eccentric bushing having an inner bore with an axial center line offset from an axial center line of said body portion by a first distance;

a second eccentric bushing having a body portion rotatably secured in a second of said apertures of said base, said second eccentric bushing having an inner bore with an axial center line offset from the axial center line of said body portion by a second distance, said second distance being different from said first distance; and;

a fixed length link having a first end with a first pin portion received in said inner bore of said first eccentric bushing and a second end with a second pin portion received in said inner bore of said second eccentric bushing wherein rotation of said first and second eccentric bushings changes the distance between said apertures of said base, thereby changing a set angle between said motor flange and said pump flange about said hinge, the fixed length link first and second ends remaining positionally fixed during operation of the pump.

2. An angle adjustment mechanism as defined in claim 1, wherein said body portion of said second eccentric bushing has a diameter different from a diameter of the body portion of said first eccentric bushing.

3. An angle adjustment mechanism as defined in claim 1, wherein one of said first and second offset distances is in the range between 0.015" and 0.050" for coarse adjustment of the distance between said apertures, and the other of said first and second offset distances is in the range between 0.000" and 0.015" for fine adjustment of the distance between said apertures.

4. An angle adjustment mechanism as defined in claim 1, wherein each of said eccentric bushings comprises a head portion terminating one end of said body portion for facilitating rotation of said eccentric bushing.

5. An angle adjustment mechanism as defined in claim 4, wherein said head portion comprises a notch located at a distance furthest from said center line of said inner bore.

6. An angle adjustment mechanism as defined in claim 1, wherein said hinge of said base is a living hinge formed integral with said base.

7. An angle adjustment mechanism as defined in claim 1, wherein said fixed link comprises a pair of complimentary segments, each segment including an insertion pin portion and a receptacle pin portion, the insertion pin portion of each segment being received in the receptacle portion of the other segment.

8. A motor and pump assembly comprising:

a base including a motor flange, a pump flange opposite said motor flange, a hinge disposed between said motor flange and said pump flange and a pair of spaced apertures disposed opposite said hinge;

a motor mounted to said motor flange of said base, said motor having a shaft rotatable about a rotation axis;

a pump mounted to said pump flange of said base, said pump having a piston rotatable about a rotation axis and linearly translatable along the rotation axis, said pump piston being coupled to said motor shaft;

a first eccentric bushing having a body portion received in a first of said apertures of said base, said first eccentric bushing having an inner bore with an axial center line offset from an axial center line of said body portion by a first distance;

a second eccentric bushing having a body portion received in a second of said apertures of said base, said second eccentric bushing having an inner bore with an axial center line offset from the axial center line of said body portion by a second distance, said second distance being different from said first distance; and a fixed length link having a first end with a first pin portion received in said inner bore of said first eccentric bushing and a second end with a second pin portion received in said inner bore of said second eccentric bushing, wherein rotation of said first and second eccentric bushings changes the distance between said apertures of said base, thereby changing an angle between said rotation axis of said motor shaft and said rotation axis of said pump piston about said hinge, and the link first and second ends remain positionally fixed during operation of the pump, thereby maintaining the angle-between said rotation axis of said motor shaft and said rotation axis of said pump piston.

9. A motor and pump assembly as defined in claim 8, wherein said body portion of said second eccentric bushing has a diameter different from a diameter of the body portion of said first eccentric bushing.

10. A motor and pump assembly as defined in claim 8, wherein one of said first and second offset distances is in the range between 0.015" and 0.050" for coarse adjustment of the distance between said apertures, and the other of said first and second offset distances is in the range between 0.000" and 0.015" for fine adjustment of the distance between said apertures.

11. A motor and pump assembly as defined in claim 8, wherein each of said eccentric bushings comprises a head portion terminating one end of said body portion for facilitating rotation of said eccentric bushing.

12. A motor and pump assembly as defined in claim 11, wherein said head portion comprises a notch located at a distance furthest from said center line of said inner bore.

13. A motor and pump assembly as defined in claim 8, wherein said hinge of said base is a living hinge formed integral with said base.

14. A motor and pump assembly as defined in claim 8, wherein said fixed link comprises a pair of complimentary segments, each segment including an insertion pin portion and a receptacle pin portion, the insertion pin portion of each segment being received in the receptacle portion of the other segment.

15. A method for adjusting the angular orientation between a motor shaft of a motor and a pump piston of a pump comprising:

providing a base between the motor and the pump, the base including a motor flange for mounting the motor, a pump flange opposite the motor flange for mounting the pump, a hinge disposed between the motor flange and the pump flange and a pair of spaced apertures disposed opposite the hinge;

rotating a first eccentric bushing having a body portion rotatably secured within a first of said apertures of said base, said first eccentric bushing having an inner bore with an axial center line offset from an axial center line of said body portion by a first distance;

rotating a second eccentric bushing having a body portion rotatably secured a second of said apertures of said base, said second eccentric bushing having an inner bore with an axial center line offset from the axial center line of said body portion by a second distance, said second distance being different from said first distance, providing a fixed length link having a first end with a first pin portion received in said inner bore of said first eccentric bushing and a second end with a second pin portion received in said inner bore of said second eccentric bushing, whereby rotation of said first and second eccentric bushings changes a distance between the apertures of said base, thereby changing set angle between said motor shaft and said pump piston about said hinge, the fixed length link first and second ends remaining positionally fixed during operation of the pump.

16. A method as defined in claim 15, wherein said body portion of said second eccentric bushing has a diameter different from a diameter of the body portion of said first eccentric bushing.

17. A method as defined in claim 15, wherein one of said first and second offset distances is in the range between 0.015" and 0.050" for coarse adjustment of the distance between said apertures, and the other of said first and second offset distances is in the range between 0.000" and 0.015" for fine adjustment of the distance between said apertures.

18. A method as defined in claim 15, wherein said eccentric bushings are rotated using a wrench engaged with a hexagonal head portion of each of said bushings.

* * * * *